US011852994B2

(12) United States Patent
Yamaguchi et al.

(10) Patent No.: US 11,852,994 B2
(45) Date of Patent: Dec. 26, 2023

(54) FIXING DEVICE AND IMAGE FORMING APPARATUS INCORPORATING SAME

(71) Applicants: Yoshiki Yamaguchi, Kanagawa (JP); Ippei Fujimoto, Kanagawa (JP)

(72) Inventors: Yoshiki Yamaguchi, Kanagawa (JP); Ippei Fujimoto, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/761,194

(22) PCT Filed: Nov. 17, 2020

(86) PCT No.: PCT/IB2020/060795
§ 371 (c)(1),
(2) Date: Mar. 17, 2022

(87) PCT Pub. No.: WO2021/123954
PCT Pub. Date: Jun. 24, 2021

(65) Prior Publication Data

US 2022/0373945 A1 Nov. 24, 2022

(30) Foreign Application Priority Data

Dec. 17, 2019 (JP) ..... 2019-227137

(51) Int. Cl.
*G03G 15/20* (2006.01)

(52) U.S. Cl.
CPC ..... *G03G 15/2053* (2013.01); *G03G 15/2025* (2013.01); *G03G 15/2042* (2013.01)

(58) Field of Classification Search
CPC ..... G03G 15/2017; G03G 15/2025; G03G 15/2039; G03G 15/2042; G03G 15/2053; G03G 2215/2003
See application file for complete search history.

(56) References Cited

U.S. PATENT DOCUMENTS 4,887,964 A * 12/1989 Takeuchi ..... G03G 15/2057 432/60
2012/0155919 A1 6/2012 Cardoso et al.
(Continued)

FOREIGN PATENT DOCUMENTS

JP 64-015781 1/1989
JP 64-015782 1/1989
(Continued)

OTHER PUBLICATIONS

International Search Report dated Feb. 5, 2021 in PCT/IB2020/060795 filed on Nov. 17, 2020, 10 pages.
(Continued)

*Primary Examiner* — Thomas S Giampaolo, II
(74) *Attorney, Agent, or Firm* — XSENSUS LLP

(57) ABSTRACT

The fixing device includes a fixing member, a heat source, a pressure member, a nip forming member, and a heat equalizing member. The heat equalizing member covers a face of the nip forming member, the face facing the fixing member, and transfers heat in an axial direction of the fixing member. The fixing member includes at least a tubular base made of metal and a sliding layer made of heat resistant resin on an inner circumferential surface of the base. The heat equalizing member made of aluminum or an aluminum alloy includes an alumite layer on a surface facing an inner circumferential surface of the fixing member. A plurality of micropores in the alumite layer is filled with a solid lubricant having a coefficient of friction lower than that of the alumite layer. The alumite layer has a thickness smaller than that of the sliding layer of the fixing member.

12 Claims, 7 Drawing Sheets

(56) References Cited

U.S. PATENT DOCUMENTS

| | | | |
|---|---|---|---|
| 2013/0223903 | A1 | 8/2013 | Matsuura |
| 2014/0023413 | A1 | 1/2014 | Shinji et al. |
| 2020/0285182 | A1 | 9/2020 | Takahashi et al. |
| 2020/0387094 | A1 | 12/2020 | Yamaguchi et al. |

FOREIGN PATENT DOCUMENTS

| | | |
|---|---|---|
| JP | 9-197880 | 7/1997 |
| JP | 2013-210608 A | 10/2013 |
| JP | 2014-038311 | 2/2014 |
| JP | 2017-125922 | 7/2017 |

OTHER PUBLICATIONS

Office Action dated Sep. 5, 2023 in Japanese Patent Application No. 2019-227137, 7 pages.

* cited by examiner

FIXING DEVICE AND IMAGE FORMING APPARATUS INCORPORATING SAME

CROSS-REFERENCE TO RELATED APPLICATIONS

The present application is based on PCT/IB2020/060795 filed on Nov. 17, 2020, which claims priority to Japanese Patent Application 2019-227137, filed Dec. 17, 2019, each of which is incorporated herein by reference in its entirety.

TECHNICAL FIELD

Embodiments of the present disclosure relate to a fixing device and an image forming apparatus incorporating the fixing device.

BACKGROUND ART

In recent years, there have been provided fixing devices that achieve a reliable fixing property with a thin, film-like endless belt having a decreased thermal capacity and directly heated by a fixing heat source, even when the fixing devices are installed in image forming apparatuses having high productivity.

In such fixing devices, a rotation member disposed opposite an outer circumferential surface of the endless fixing belt is pressed against, via the fixing belt, a support member (or a nip forming member) fixed inside (or inside a loop formed by) the fixing belt, to form a fixing nip between the rotation member and the support member. The nip forming member may be provided with a heat equalizing member made of a metal material having an increased thermal conductivity, to uniformly heat the fixing belt and reduce a temperature rise at end portions of the fixing belt during continuous conveyance of recording media.

There has been known a configuration of such fixing devices in which a sheet material (or sliding sheet) made from fibers of, e.g., polytetrafluoroethylene (PTFE) impregnated with a lubricant such as silicone grease is disposed on the surface of the nip forming member to reduce the sliding resistance (or torque) between the fixing belt and the nip forming member. However, the sliding sheet may serve a heat insulation member, hampering the heat equalization of the fixing belt.

To address such a situation, there has been also known a configuration in which, instead of the sliding sheet, a slidable coating is directly applied to the surface of the heat equalizing member (for example, PTL1 and PTL 2). Further, there has been proposed a configuration in which an appropriate surface roughness is formed on the surface of the coating layer to hold a grease.

CITATION LIST

Patent Literature

[PTL 1]
Japanese Unexamined Patent Application Publication No. 2017-125922
[PTL 2]
Japanese Unexamined Patent Application Publication No. H9-197880

SUMMARY OF INVENTION

Technical Problem

When the surface of the heat equalizing member is coated with, e.g., a coating material containing PTFE, a firing process may be performed to enhance the adhesion and strength of a coating film. However, since the heat equalizing member is a thin plate, the heat equalizing member may be deformed due to the heat history during the firing process. To prevent such deformation of the heat equalizing member, the firing process is performed at a temperature lower than a temperature at which the original coating film performance is exerted.

Relatedly, when agglomerates are generated in the coating material, a minute convex shape is formed on the surface of the coating film. This convex shape promotes wear on an inner surface of the fixing belt (or an inner surface of a sleeve) and generates abrasion powder. As a consequence, the unit torque of the fixing device may increase at an early stage.

In light of the above-described problems, it is a general object of the present invention to provide a fixing device that performs a reliable fixing operation over time by keeping a reduced sliding resistance between the heat equalizing member and a fixing member without impairing the reliability and heat equalizing property of the heat equalizing member.

Solution to Problem

In order to solve the above-described problems and achieve the object, there is provided a fixing device as described in appended claims. Advantageous embodiments are defined by the dependent claims. Advantageously, the fixing device includes a rotatable and endless fixing member, a heat source, a pressure member, a nip forming member, and a heat equalizing member. The heat source is configured to heat the fixing member. The pressure member is disposed outside the fixing member to face the fixing member. The nip forming member is disposed inside the fixing member to form a nip between the fixing member and the pressure member. The heat equalizing member is configured to cover a face of the nip forming member, the face facing the fixing member, and transfer heat in an axial direction of the fixing member. The fixing member includes at least: a tubular base made of metal; and a sliding layer made of heat resistant resin on an inner circumferential surface of the base. The heat equalizing member is made of aluminum or an aluminum alloy. The heat equalizing member includes an alumite layer on a surface facing an inner circumferential surface of the fixing member. A plurality of micropores in the alumite layer is filled with a solid lubricant having a coefficient of friction lower than a coefficient of friction of the alumite layer. The alumite layer has a thickness smaller than a thickness of the sliding layer of the fixing member.

Advantageous Effects of Invention

In a fixing device of an embodiment of the present disclosure, an alumite layer is formed on the surface of a heat equalizing member. A plurality of micropores in the alumite layer is filled with a solid lubricant. Accordingly, the fixing device maintains lubrication between the heat equalizing member and a fixing member. In addition, the alumite layer having a thickness smaller than the thickness of a sliding layer of the fixing member does not impair the heat equalizing property of the heat equalizing member. Further, the alumite treatment does not cause deformation of the member or slight convexity as compared to the coating treatment, thus enhancing the reliability of the heat equalizing member.

BRIEF DESCRIPTION OF DRAWINGS

The accompanying drawings are intended to depict example embodiments of the present invention and should not be interpreted to limit the scope thereof. The accompanying drawings are not to be considered as drawn to scale unless explicitly noted. Also, identical or similar reference numerals designate identical or similar components throughout the several views.

FIG. 11A is a cross-sectional view of a heat equalizing member and a fixing belt, according to a comparative example; whereas

DESCRIPTION OF EMBODIMENTS

Figure 1:
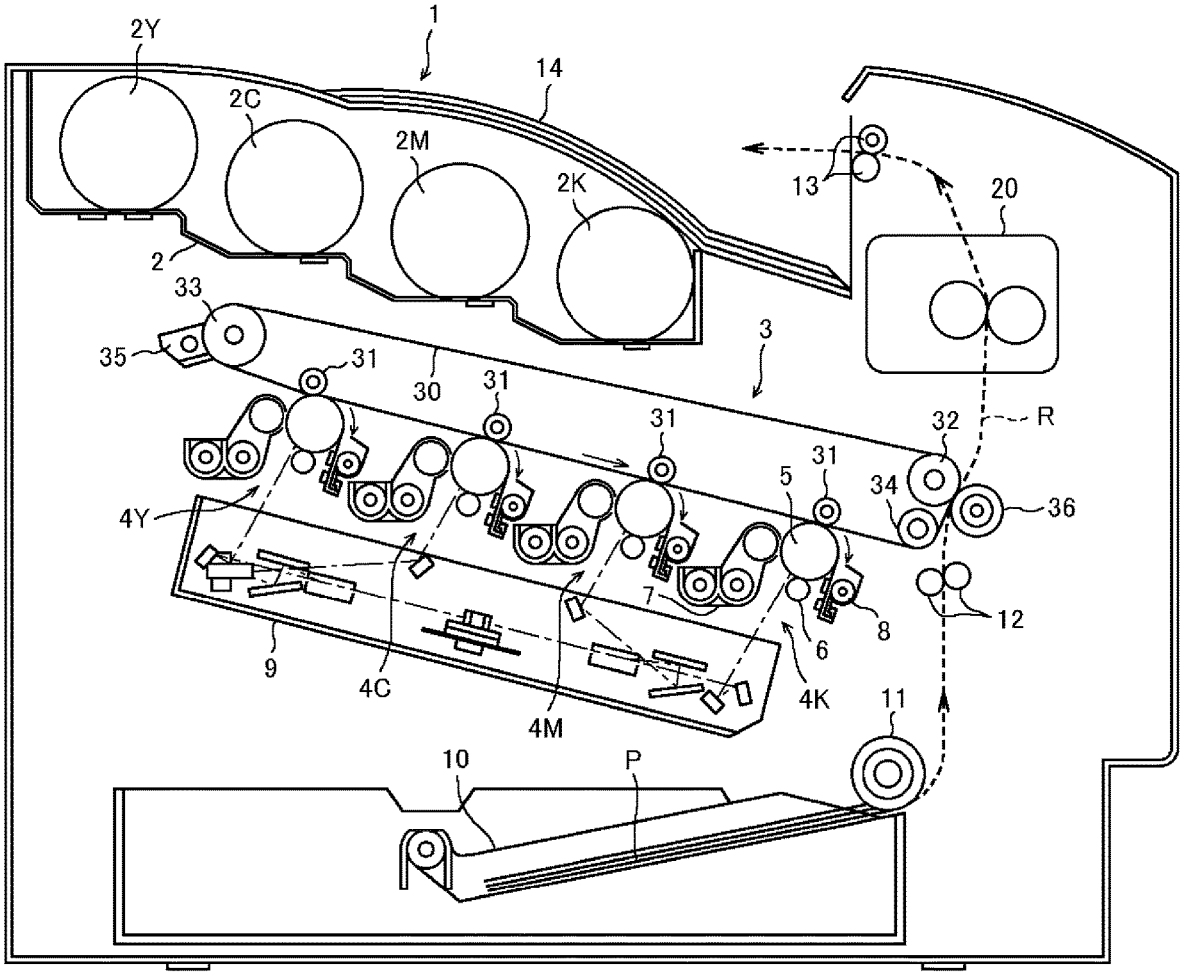
FIG. 1 is a schematic view of an image forming apparatus, according to an embodiment of the present disclosure.

The terminology used herein is for the purpose of describing particular embodiments only and is not intended to be limiting of the present invention. As used herein, the singular forms "a", "an" and "the" are intended to include the plural forms as well, unless the context clearly indicates otherwise. In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, wherein like reference numerals designate identical or corresponding parts throughout the several views, embodiments of the present disclosure are described in detail below. FIG. 1 is a schematic view of an image forming apparatus, according to an embodiment of the present disclosure. An image forming apparatus 1 is a color laser printer. In the center of a printer body of the image forming apparatus 1, four image forming units 4Y, 4C, 4M, and 4K are arranged side by side along a direction in which an intermediate transfer belt 30 is stretched. The image forming units 4Y, 4C, 4M, and 4K have identical configurations while containing developers in different colors, that is, yellow (Y), cyan (C), magenta (M), and black (K) corresponding to color separation components of a color image.

Specifically, each of the image forming units 4Y, 4C, 4M, and 4K serving as an image station includes, e.g., a drum-shaped photoconductor 5 as a latent image bearer, a charging device 6 that charges the surface of the photoconductor 5, a developing device 7 that supplies toner to the surface of the photoconductor 5, and a cleaning device 8 that cleans the surface of the photoconductor 5. Note that, in FIG. 1, reference numerals are assigned to the photoconductor 5, the charging device 6, the developing device 7, and the cleaning device 8 of the image forming unit 4K that forms a black toner image; whereas reference numerals are omitted for the other image forming units 4Y, 4C, and 4M.

An exposure device 9 is disposed below the image forming units 4Y, 4C, 4M, and 4K to expose the surface of the photoconductor 5. The exposure device 9 includes, e.g., a light source, a polygon mirror, an f-θ lens, and a reflection mirror to irradiate the surface of each of the photoconductors 5 with a laser beam according to image data.

A transfer device 3 is disposed above the image forming units 4Y, 4C, 4M, and 4K. The transfer device 3 includes the intermediate transfer belt 30 as a transfer body, four primary transfer rollers 31 as primary transfer means, and a secondary transfer roller 36 as secondary transfer means. The transfer device 3 further includes a secondary transfer backup roller 32, a cleaning backup roller 33, a tension roller 34, and a belt cleaning device 35.

The intermediate transfer belt 30 is an endless belt entrained around the secondary transfer backup roller 32, the cleaning backup roller 33, and the tension roller 34. Here, as the secondary transfer backup roller 32 is driven to rotate, the intermediate transfer belt 30 orbits (or rotates) in a direction indicated by arrow in FIG. 1.

Each of the four primary transfer rollers 31 sandwiches the intermediate transfer belt 30 together with the corresponding photoconductors 5, thereby forming a primary transfer nip between the intermediate transfer belt 30 and the corresponding photoconductor 5. The primary transfer rollers 31 are coupled to a power supply of the printer body. The power supply applies at least one of a predetermined direct current (DC) voltage and a predetermined alternating current (AC) voltage to the primary transfer rollers 31.

The secondary transfer roller 36 sandwiches the intermediate transfer belt 30 together with the secondary transfer backup roller 32, thereby forming a secondary transfer nip between the secondary transfer roller 36 and the intermediate transfer belt 30. Similar to the primary transfer rollers 31, the secondary transfer roller 36 is coupled to the power supply of the printer body. The power supply applies at least one of a predetermined DC voltage and a predetermined AC voltage to the secondary transfer roller 36.

The belt cleaning device 35 includes a cleaning brush and a cleaning blade disposed to contact the intermediate transfer belt 30. A bottle receptacle 2 is disposed in an upper portion of the printer body. Four toner bottles 2Y, 2C, 2M, and 2K containing fresh toner are removably attached to the bottle receptacle 2. Toner supply tubes are interposed between the toner bottles 2Y, 2C, 2M, and 2K and the respective developing devices 7. The fresh toner is supplied from each of the toner bottles 2Y, 2C, 2M, and 2K to the corresponding developing device 7 through the corresponding toner supply tube.

In a lower portion of the printer body are, e.g., an input tray 10 that accommodates a plurality of sheets P as recording media and a sheet feeding roller 11 that sends out the plurality of sheets P one at a time from the input tray 10. Here, examples of the recording medium include, but are not limited to, plain paper, thick paper, a postcard, an envelope, thin paper, coated paper, art paper, tracing paper, and an overhead projector (OHP) transparency. Optionally, the image forming apparatus 1 may include a bypass feeder that imports such a recording medium placed on a bypass tray into the image forming apparatus 1.

Inside the printer body, a conveyance passage R is defined by internal components of the image forming apparatus 1. Along the conveyance passage R, the sheet P is conveyed from the input tray 10, passing through the secondary transfer nip, and is ejected outside the image forming apparatus 1. Along the conveyance passage R, a registration roller pair 12 is disposed upstream from the position of the secondary transfer roller 36 in a sheet conveyance direction in which the sheet P is conveyed. The registration roller pair 12 is conveying means that conveys the sheet P to the secondary transfer nip.

In addition, a fixing device 20 is disposed downstream from the position of the secondary transfer roller 36 in the sheet conveyance direction. The fixing device 20 fixes, onto the sheet P, an unfixed image that has been transferred onto the sheet P. Further, a sheet ejection roller pair 13 is disposed downstream from the fixing device 20 in the sheet conveyance direction along the conveyance passage R. The sheet ejection roller pair 13 ejects the sheet P outside the image forming apparatus 1. An output tray 14 is disposed on an upper surface of the printer body. The plurality of sheets P ejected one at a time outside the image forming apparatus 1 lies stacked on the output tray 14.

A description is now given of a basic operation of the printer according to the present embodiment. When an image forming operation starts, the photoconductor 5 is driven to rotate clockwise in FIG. 1 in each of the image forming units 4Y, 4C, 4M, and 4K. The charging device 6 uniformly charges the surface of the photoconductor 5 to a predetermined polarity. The exposure device 9 irradiates the charged surface of the photoconductor 5 with a laser beam to form an electrostatic latent image on the surface of the photoconductor 5. Note that the image data according to which the photoconductor 5 is exposed is single-color image data obtained by separating a desired full-color image into individual color components of yellow, cyan, magenta, and black. The developing device 7 supplies toner to the electrostatic latent image thus formed on the photoconductor 5 to render the electrostatic latent image visible as a toner image.

Meanwhile, when the image forming operation starts, the secondary transfer backup roller 32 is driven to rotate counterclockwise in FIG. 1 and rotates the intermediate transfer belt 30 in a direction indicated by arrow in FIG. 1. Each of the primary transfer rollers 31 is supplied with a constant voltage or constant current control voltage having a polarity opposite a polarity of the charged toner. Accordingly, a transfer electric field is generated at the primary transfer nip between each of the primary transfer rollers 31 and the corresponding photoconductor 5.

When the toner images in different colors formed on the respective photoconductors 5 reach the respective primary transfer nips in accordance with rotation of the respective photoconductors 5, the toner images are transferred, by the transfer electric fields generated at the respective primary transfer nips, from the respective photoconductor 5 onto the intermediate transfer belt 30 such that the toner images are sequentially superimposed one atop another on the intermediate transfer belt 30. Thus, a full-color toner image is formed on the surface of the intermediate transfer belt 30. The cleaning device 8 removes residual toner from the photoconductor 5. In this case, the residual toner is toner that has failed to be transferred onto the intermediate transfer belt 30 and therefore remains on the photoconductor 5. Then, a discharger discharges the surface of the photoconductor 5 to initialize the surface potential of the photoconductor 5.

In the lower portion of the image forming apparatus 1, the sheet feeding roller 11 starts rotation to feed the sheet P from the input tray 10 to the conveyance passage R. The registration roller pair 12 conveys the sheet P fed to the conveyance passage R to the secondary transfer nip between the secondary transfer roller 36 and the secondary transfer backup roller 32 at a proper time. At this time, the secondary transfer roller 36 is supplied with a transfer voltage having a polarity opposite a polarity of the charged toner contained in the full-color toner image formed on the intermediate transfer belt 30, thereby generating a transfer electric field at the secondary transfer nip.

Thereafter, when the toner images on the intermediate transfer belt 30 reach the secondary transfer nip in accordance with rotation of the intermediate transfer belt 30, the transfer electric field generated at the secondary transfer nip collectively transfers the toner images from the intermediate transfer belt 30 onto the sheet P. The belt cleaning device 35 removes residual toner from the intermediate transfer belt 30. In this case, the residual toner is toner that has failed to be transferred onto the sheet P and therefore remains on the intermediate transfer belt 30. The removed toner is conveyed and collected into a waste toner container disposed inside the printer body.

Thereafter, the sheet P is conveyed to the fixing device 20. The fixing device 20 fixes the toner images resting on the sheet P onto the sheet P. Then, the sheet ejection roller pair 13 ejects the sheet P outside the image forming apparatus 1. Thus, a plurality of sheets P lies stacked on the output tray 14.

As described above, the image forming apparatus 1 performs an image forming operation to form a full-color image on the sheet P. Alternatively, the image forming apparatus 1 may use any one of the image forming units 4Y, 4C, 4M, and 4K to form a monochrome image. Alternatively, the image forming apparatus 1 may use two of the image forming units 4Y, 4C, 4M, and 4K to form a bicolor image, or may use three of the image forming units 4Y, 4C, 4M, and 4K to form a tricolor image.

Figure 2:
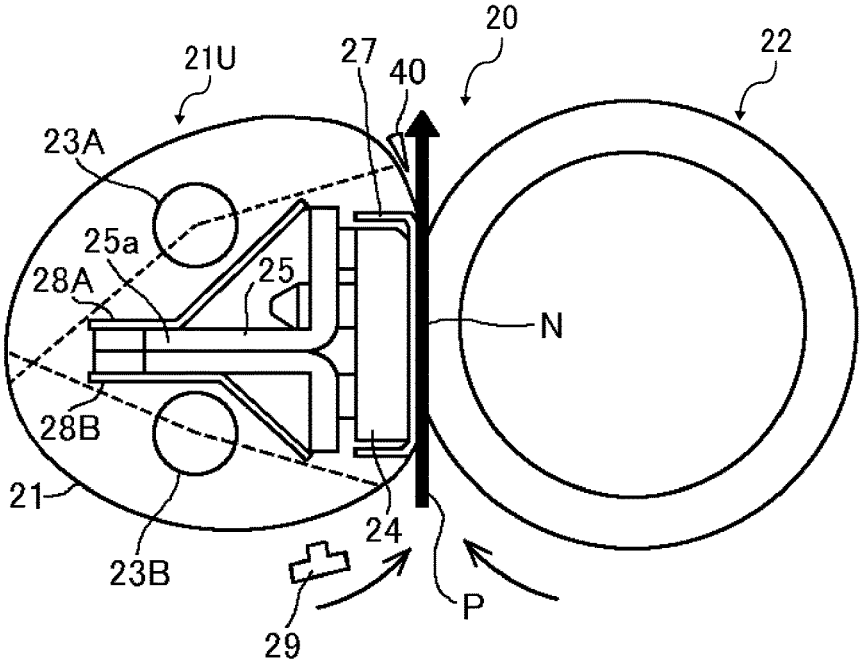
FIG. 2 is a schematic cross-sectional view of a fixing device, according to an embodiment of the present disclosure.

FIG. 2 is a schematic cross-sectional view of a fixing device, according to an embodiment of the present disclosure. As illustrated in FIG. 2, the fixing device 20 includes a fixing belt 21 formed into a loop, a pressure roller 22, a temperature sensor 29, a separating member 40, and various components disposed inside the loop formed by the fixing belt 21, such as heaters 23A and 23B, a nip forming member 24, a stay member 25, a heat equalizing member 27, and reflecting members 28A and 28B. The fixing belt 21 and the components disposed inside the loop formed by the fixing belt 21 constitute a belt unit 21U, detachably coupled to the pressure roller 22. The fixing belt 21 is an endless belt that is a thin, flexible, and tubular fixing member. The pressure roller 22 is a pressure member that contacts an outer circumferential surface of the fixing belt 21. The fixing belt 21 is heated by radiation heat from the heaters 23A and 23B, serving as a plurality of heat sources (or fixing heat sources), disposed inside (or inside the loop formed by) the fixing belt 21. A halogen heater is generally used as the heat source.

Alternatively, the heat source may be, e.g., an induction heating device, a resistive heat generator, or a carbon heater.

Inside the fixing belt 21 are the nip forming member 24 and the stay member 25. The nip forming member 24 forms a fixing nip N between the fixing belt 21 and the pressure roller 22. The stay member 25 (serving as a support member) supports the nip forming member 24. The stay member 25 secures and supports the nip forming member 24 disposed along an axial direction of the fixing belt 21, thus preventing the nip forming member 24 from being bent by pressure that the nip forming member 24 receives from the pressure roller 22. Accordingly, the fixing nip N is formed retaining an even width along an axial direction (i.e., longitudinal direction) of the pressure roller 22.

Figure 3:
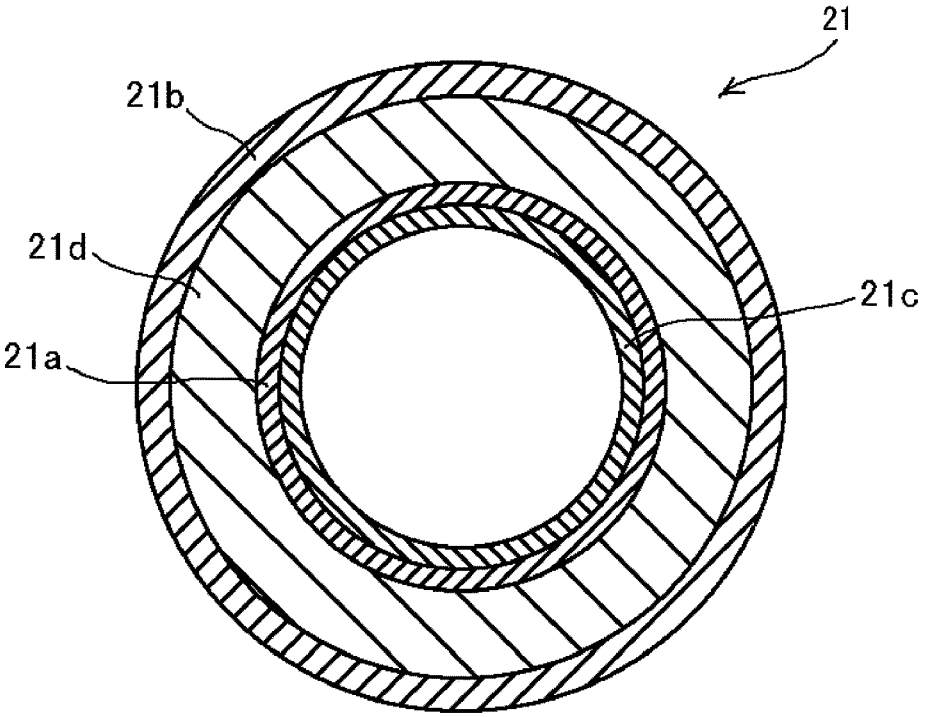
FIG. 3 is a cross-sectional view of a fixing belt, according to an embodiment of the present disclosure.

FIG. 3 is a cross-sectional view of a fixing belt, according to an embodiment of the present disclosure. As illustrated in FIG. 3, the fixing belt 21 includes at least a tubular base 21*a* made of metal or heat resistant resin, a release layer 21*b* made of heat resistant resin and provided on an outer circumferential surface of the base 21*a*, and a sliding layer 21*c* made of resin on an inner circumferential surface of the base 21*a*.

The base 21*a* has a thickness in a range of from 20 μm to 50 μm. The base 21*a* is made of a metal material such as nickel or steel use stainless (SUS), or a resin material such as polyimide (PI) or polyamide imide (PAI).

The release layer 21*b* has a layer thickness in a range of from 10 μm to 50 μm. The release layer 21*b* is made of a material such as tetrafluoroethylene-perfluoroalkylvinylether copolymer (PFA) or polytetrafluoroethylene (PTFE). The release layer 21*b* ensures the releasability of the fixing belt 21 with respect to the toner image on the sheet P. Note that the "release" means to peel off an object from another object adhering to the object. The "releasability" means the ease with which the objects can be separated from each other.

Optionally, an elastic layer 21*d* made of, e.g., silicone rubber may be interposed between the base 21*a* and the release layer 21*b*. In a case in which the fixing belt 21 does not incorporate the elastic layer 21*d*, the fixing belt 21 has a decreased thermal capacity that improves fixing property. However, as the fixing belt 21 and the pressure roller 22 sandwich and press an unfixed image onto the sheet P at the fixing nip N, slight surface asperities in the fixing belt 21 may be transferred onto the toner image on the sheet P, resulting in appearance of an orange peel image having orange-peel-like variation in gloss in a solid image portion of the image. Here, the orange peel image means an image having slight surface asperities. To address such a situation, the elastic layer 21*d* made of silicone rubber preferably has a thickness not smaller than 100 μm. The deformation of the elastic layer 21*d* absorbs the slight surface asperities in the fixing belt 21, thus preventing the appearance of the orange peel image.

As the sliding layer 21*c*, for example, PAI or fluororesin having heat resistance and slidability is preferable. As the fluororesin, PTFE or PFA is preferable. In a case in which the sliding layer 21*c* is made of a mixed coating material of fluororesin and PAI, the sliding layer 21*c* has a reduced coefficient of dynamic friction and enhances the adhesion to the base 21*a*.

The sliding layer 21*c* is applied to the inner circumferential surface of the base 21*a* of the fixing belt 21 by spray coating, for example, so as to have a thickness of about 15 μm. However, if the thickness is smaller than 15 μm and particularly smaller than 10 μm coating unevenness (i.e., partial color unevenness in the coating film) may occur.

The sliding layer 21*c* thus formed has a coefficient of dynamic friction not greater than 0.1 and a tensile elastic modulus not greater than 5000 Mpa.

In order to reduce thermal capacity, the fixing belt 21 has a total thickness not greater than 1 mm and a loop diameter in a range of from 20 mm to 40 mm. In order to further reduce thermal capacity, preferably, the fixing belt 21 may have a total thickness not greater than 0.2 mm, and more preferably, not greater than 0.16 mm. Preferably, the loop diameter of the fixing belt 21 is not greater than 30 mm.

Referring back to FIG. 2, a description is now resumed of other components. The nip forming member 24 is made of a heat resistant material having good mechanical strength and heatproof not less than 200° C. In particular, the nip forming member 24 is made of heat resistant resin such as PI or polyether ether ketone (PEEK), or such a heat resistant resin reinforced with glass fibers. Thus, the nip forming member 24 is immune to thermal deformation at temperatures in a fixing temperature range desirable to fix a toner image onto a sheet P, thereby retaining a stable state of the fixing nip N and keeping the output image quality stable. Opposed longitudinal end portions of the stay member 25 and opposed longitudinal end portions of the heaters 23A and 23B are secured to and supported by a pair of side plates of the fixing device 20 or a pair of holders provided additionally.

The heat equalizing member 27 is a heat transfer aid member that facilitates heat transfer in the axial direction of the fixing belt 21. The heat equalizing member 27 is disposed to cover a nip-side face of the nip forming member 24. The nip-side face of the nip forming member 24 faces the inner circumferential surface of the fixing belt 21. The heat equalizing member 27 proactively transfers heat in the axial direction of the fixing belt 21, that is, in a longitudinal direction of the heat equalizing member 27, thus preventing heat from staying at opposed axial end areas of the fixing belt 21 when small sheets P are conveyed over the fixing belt 21. Thus, the heat equalizing member 27 eliminates unevenness in temperature in the axial direction of the fixing belt 21. The heat equalizing member 27 of the present embodiment is made of aluminum or an aluminum alloy as a material having an increased thermal conductivity, thus enabling heat transfer in a short time.

The heat equalizing member 27 includes a belt sliding-contact face that faces in direct contact with the inner circumferential surface of the fixing belt 21, thus serving as a nip forming face. In FIG. 2, the belt sliding-contact face is flattened. Alternatively, the belt sliding-contact face may be given a concave shape or another suitable shape. For example, a concave nip forming face directs a leading edge of the sheet P toward the pressure roller 22 as the sheet P is ejected from the fixing nip N, thus facilitating separation of the sheet P from the fixing belt 21 and preventing a paper jam.

In order to reduce the wear of the fixing belt 21 and the heat equalizing member 27, fluorine oil or fluorine grease containing a fluorine compound may be applied as a lubricant to the inner circumferential surface of the fixing belt 21. The lubricant may be fluorine grease or silicone grease containing fluorine particles as a thickener.

The stay member 25, having a T-shaped cross-section, includes an arm 25*a* extending away from the fixing nip N. The arm 25*a* is interposed between the heaters 23A and 23B as fixing heat sources, to separate the heaters 23A and 23B from each other. One of the heaters 23A and 23B includes a heat generating area at a longitudinal center portion of the one of the heaters 23A and 23B to heat toner images on small sheets P passing through the fixing nip N. The other one of the heaters 23A and 23B includes a heat generating area at each longitudinal end portion of the other one of the heaters 23A and 23B to heat toner images on large sheets P passing through the fixing nip N.

The power source situated inside the printer body supplies power to the heaters 23A and the 23B so that the heaters 23A and 23B generate heat. Specifically, a controller (e.g., a processor) is operatively connected to the power source and the temperature sensor 29 to control the power supply to the heaters 23A and 23B based on the temperature of the outer circumferential surface of the fixing belt 21 detected by the temperature sensor 29 disposed opposite the outer circumferential surface of the fixing belt 21. Such heating control of the heaters 23A and 23B adjusts the temperature of the fixing belt 21 to a desired fixing temperature.

The reflecting member 28A is interposed between the heater 23A and the stay member 25. The reflecting member 28B is interposed between the heater 23B and the stay member 25. The reflecting members 28A and 28B reflect heat from the heaters 23A and 23B toward the fixing belt 21, thus enhancing heating efficiency of the heaters 23A and 23B to heat the fixing belt 21. In addition, the reflecting members 28A and 28B prevent radiation heat from the heaters 23A and 23B from heating the stay member 25, thus reducing waste of energy. Alternatively, instead of the reflecting members 28A and 28B, the respective heater-side faces of the stay member 25 facing the heaters 23A and 23B may be insulated or given a mirror finish to enhance the heating efficiency of the heaters 23A and 23B and reduce the waste of energy.

The pressure roller 22 is constructed of a core, an elastic layer made of, e.g., silicone rubber foam or fluororubber and provided on the surface of the core, and a release layer made of, e.g., PFA or PTFE and provided on the surface of the elastic layer. As the pressure roller 22 is pressed against the fixing belt 21 by pressure means such as a spring, the elastic layer of the pressure roller 22 is deformed and thus forms the fixing nip N having a predetermined width at an area of pressure contact between the fixing belt 21 and the pressure roller 22.

The pressure roller 22 is driven to rotate by a driving source such as a motor disposed inside the printer body. As the driving source drives and rotates the pressure roller 22, a driving force of the driving source is transmitted from the pressure roller 22 to the fixing belt 21 at the fixing nip N, thus rotating the fixing belt 21. While the fixing belt 21 rotates, a nip span of the fixing belt 21 located at the fixing nip N is sandwiched between the pressure roller 22 and the heat equalizing member 27. On the other hand, a circumferential span of the fixing belt 21 other than the nip span is guided by flanges secured to the pair of side plates located at opposed axial end portions of the fixing belt 21.

In the present embodiment, the pressure roller 22 is a solid roller. Alternatively, the pressure roller 22 may be a hollow roller, i.e., a tube. In a case in which the pressure roller 22 is a hollow roller, a heat source such as a halogen heater may be disposed inside the pressure roller 22. The elastic layer of the pressure roller 22 may be made of solid rubber. Alternatively, in a case in which no heat source is situated inside the pressure roller 22, the elastic layer may be made of sponge rubber. The sponge rubber is preferable to the solid rubber because the sponge rubber has an increased thermal insulation that draws less heat from the fixing belt 21.

As described above, the temperature sensor 29 is disposed at an appropriate position opposite the outer circumferential surface of the fixing belt 21, for example, upstream from the fixing nip N in a direction of rotation of the fixing belt 21, to detect the temperature of the fixing belt 21. The separating member 40 is disposed in a downstream position in the sheet conveyance direction in the fixing device 20 to separate the sheet P from the fixing belt 21. The pressure means is also provided to releasably press the pressure roller 22 against the fixing belt 21.

Figure 4:
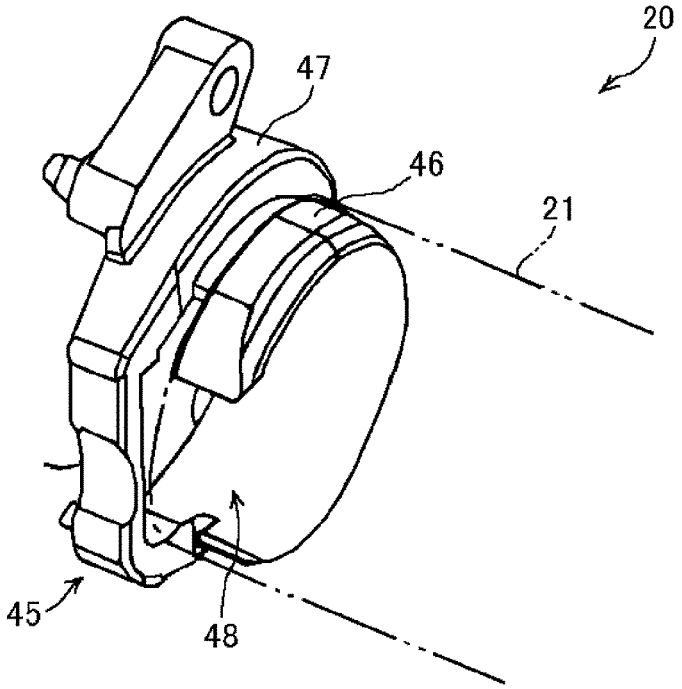
FIG. 4 is a schematic perspective view of an axial end portion of the fixing device illustrated in FIG. 2.

FIG. 4 is a schematic perspective view of an axial end portion of the fixing device 20 illustrated in FIG. 2. Flanges 45 are disposed at the respective axial end portions of the fixing belt 21. FIG. 4 illustrates one of the axial end portions of the fixing belt 21.

The flange 45 is hollow and open on both axial sides of the flange 45. The flange 45 includes a receiving portion 46 extending in an axial direction of the flange 45 and a flange portion 47 projecting from the receiving portion 46 in a radial direction. The receiving portion 46 is partially cylindrical or tubular, including a slit 48 in a partial circumferential span of the receiving portion 46. The nip forming member 24 and the heat equalizing member 27 are inserted into the space defined by the slit 48.

If the fixing belt 21 is moved or skewed in the axial direction of the fixing belt 21 in accordance with rotation of the fixing belt 21, the axial end portion of the fixing belt 21 comes into contact with the receiving portion 46, which restricts an axial motion of the fixing belt 21. The flange portion 47 is secured to the side plate of the fixing device 20. Optionally, a ring plate made of a material that provides the fixing belt 21 with good slidability may be interposed between the receiving portion 46 and the axial end portion of the fixing belt 21.

Figure 5:
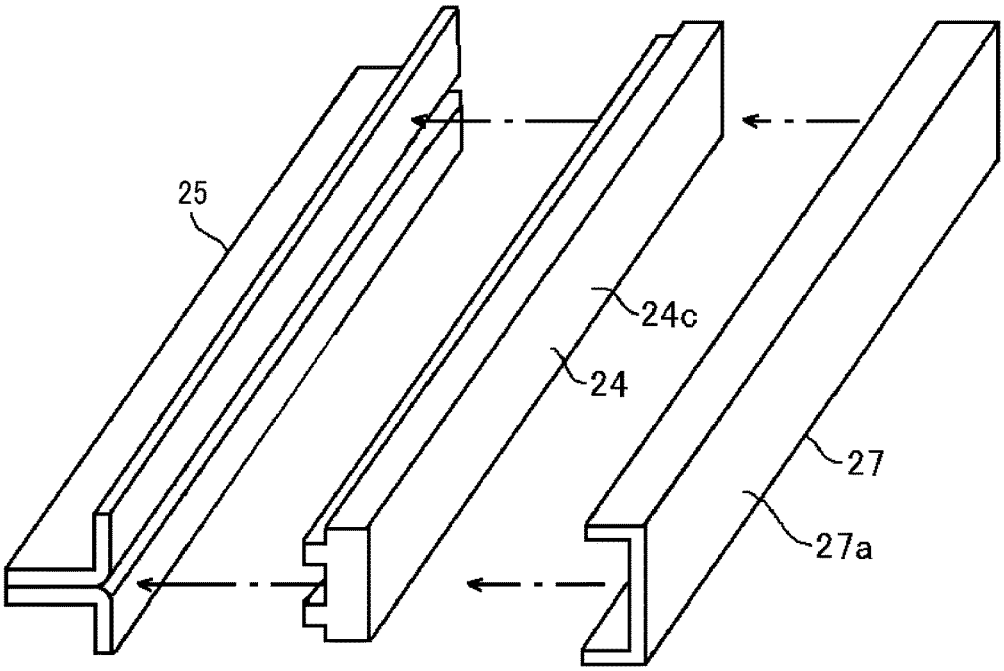
FIG. 5 is an exploded perspective view of a nip forming member, a support member, and a heat equalizing member that construct a nip forming unit, according to an embodiment of the present disclosure.

FIG. 5 is an exploded perspective view of a nip forming member, a support member, and a heat equalizing member that construct a nip forming unit, according to an embodiment of the present disclosure.

As illustrated in FIG. 5, the heat equalizing member 27 disposed on a fixing nip side of the nip forming member 24 engages the nip forming member 24, which is given an approximately rectangular shape, such that the heat equalizing member 27 covers a nip-side face 24*c*, facing the inner circumferential surface of the fixing belt 21, of the nip forming member 24. Thus, the heat equalizing member 27 is coupled to the nip forming member 24. The heat equalizing member 27 may engage the nip forming member 24 with, e.g., a projection to be coupled to the nip forming member 24. Alternatively, the heat equalizing member 27 may be attached to the nip forming member 24 with, e.g., an adhesive to be coupled to the nip forming member 24.

The heat equalizing member 27 includes a belt sliding-contact face 27*a* that faces the inner circumferential surface of the fixing belt 21. The nip forming member 24 includes a stay-side face opposite the nip-side face 24*c*. The stay member 25 includes a nip-side face that faces the fixing nip N. The nip-side face of the stay member 25 supports the stay-side face of the nip forming member 24. Preferably, the stay-side face of the nip forming member 24 and the nip-side face of the stay member 25 that contact each other may mount a recess and a projection (e.g., a boss and a pin), respectively, for example, to reduce an area of contact between the nip forming member 24 and the stay member 25.

Subsequently, a description is given of a characteristic configuration according to an embodiment of the present disclosure.

Figure 6:
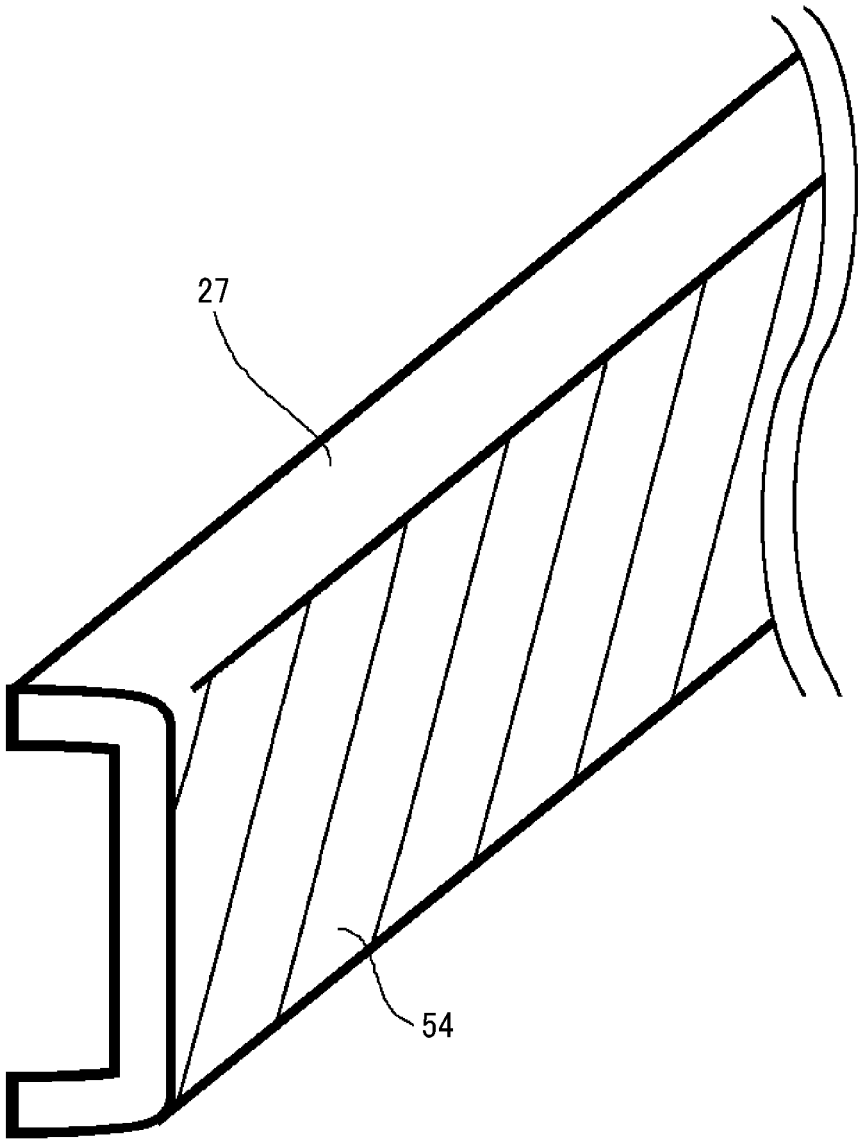
FIG. 6 is a perspective view of a heat equalizing member, according to an embodiment of the present disclosure.
Figure 7:
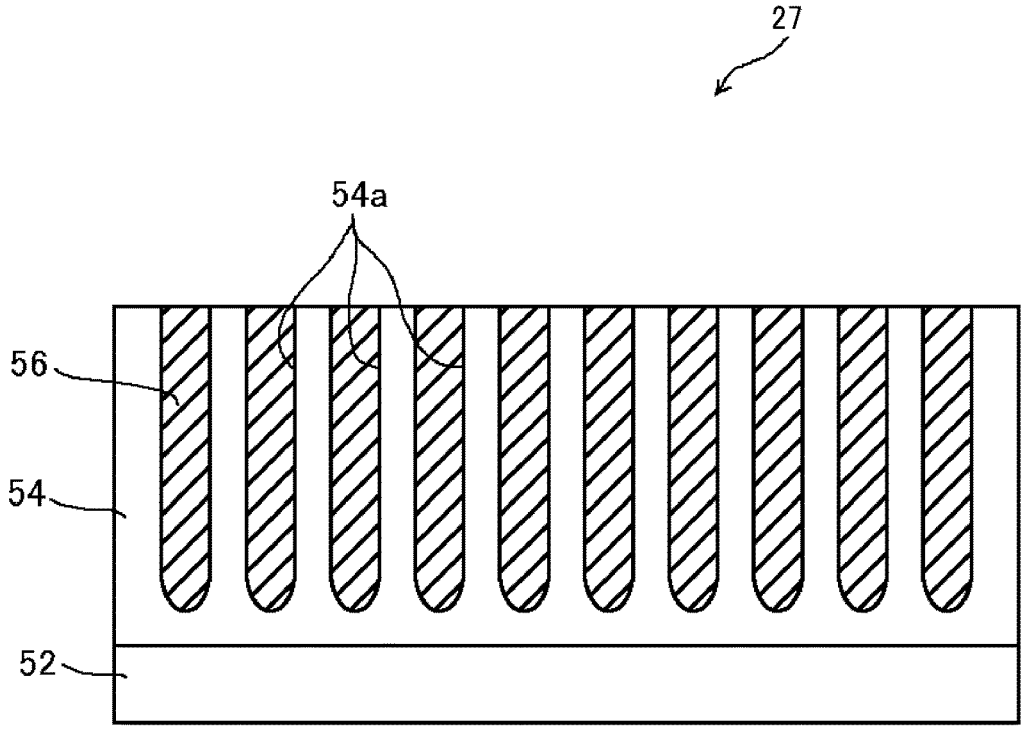
FIG. 7 is an enlarged cross-sectional view of the heat equalizing member illustrated in FIG. 6.

FIG. 6 is a perspective view of a heat equalizing member according to an embodiment of the present disclosure. FIG. 7 is an enlarged cross-sectional view of the heat equalizing member illustrated in FIG. 6. With reference to FIGS. 6 and 7, a detailed description is given of a configuration of the heat equalizing member 27.

As illustrated in FIG. 6, according to the present embodiment, the heat equalizing member 27 made of aluminum or an aluminum alloy includes an alumite film (hereinafter referred to as an alumite layer 54) on a surface of the heat equalizing member 27 (specifically, a surface facing the inner circumferential surface of the fixing belt 21). As illustrated in FIG. 7, molybdenum disulfide ($MoS_2$) 56 serving as a solid lubricant fills a plurality of micropores 54*a* regularly arranged in the alumite layer 54 (on an aluminum base material 52).

The alumite layer 54 is very hard and has good wear resistance. In particular, the alumite layer 54 has a very strong property against abrasive wear. On the other hand, the molybdenum disulfide 56 is a solid lubricant having a coefficient of friction lower than the coefficient of friction of the alumite layer 54. With such a configuration, the heat equalizing member 27 of the present embodiment serves a sliding member having both wear resistance and lubricity with respect to the inner circumferential surface of the fixing belt 21.

Figure 8:
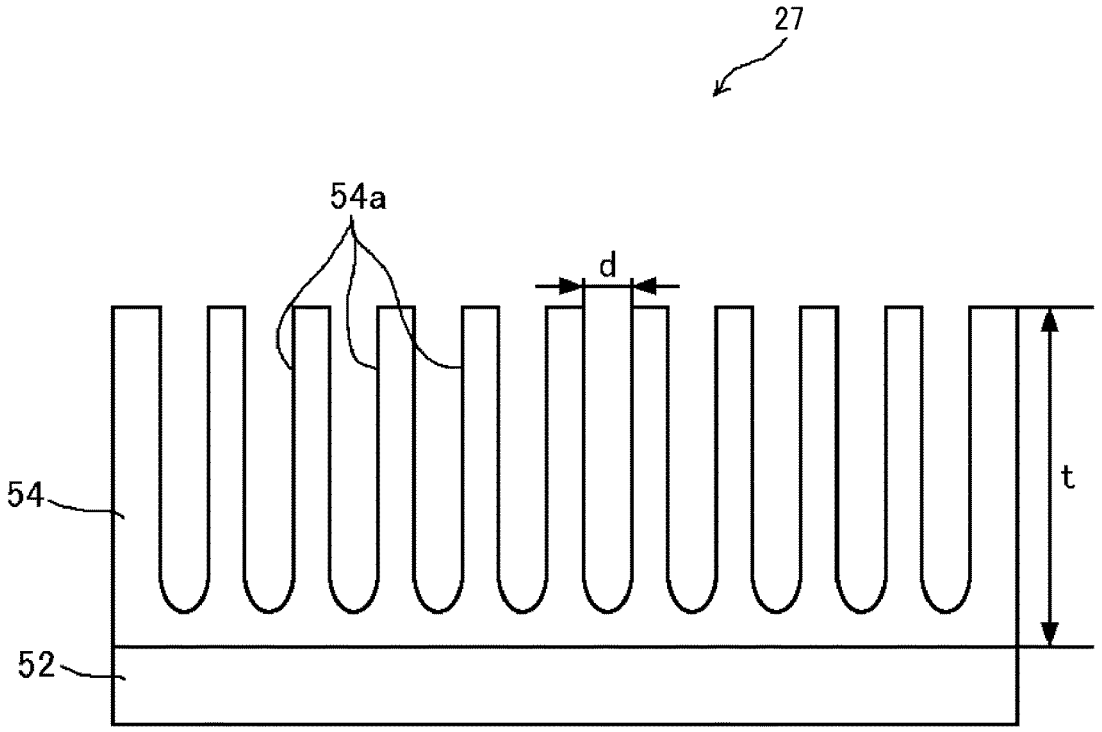
FIG. 8 is a first diagram illustrating a way of manufacturing a heat equalizing member, according to an embodiment of the present disclosure.
Figure 9:
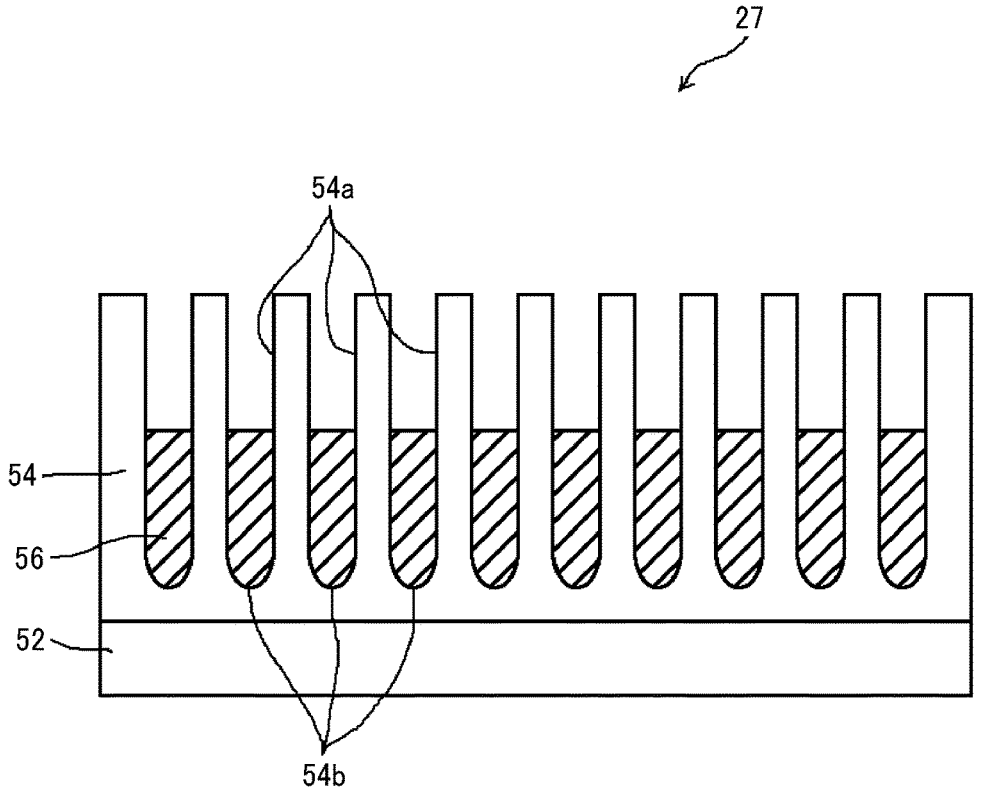
FIG. 9 is a second diagram illustrating the way of manufacturing a heat equalizing member, according to an embodiment of the present disclosure.
Figure 10:
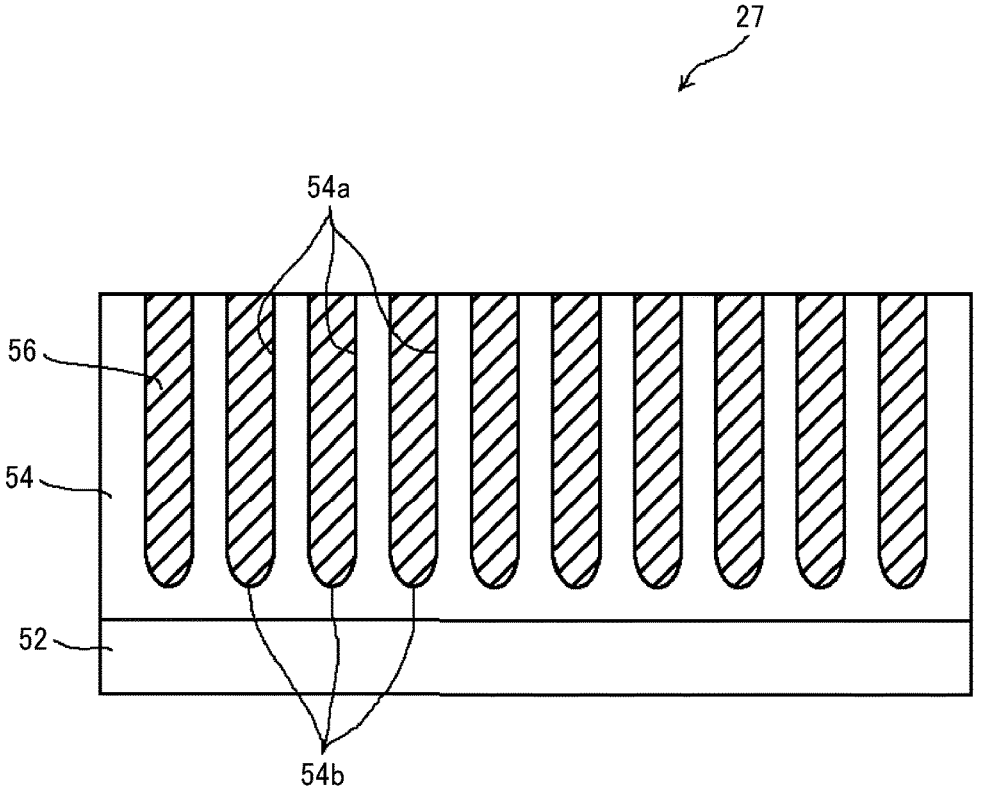
FIG. 10 is a third diagram illustrating the way of manufacturing a heat equalizing member, according to an embodiment of the present disclosure.

FIGS. 8 to 10 illustrate a way of manufacturing a heat equalizing member according to an embodiment of the present disclosure. As illustrated in FIG. 8, the aluminum base material 52 is primarily electrolyzed by a typical anodic oxidation method to form the alumite layer 54 on the surface of the aluminum base material 52. The innumerable (multiple) micropores 54*a* are generated as arranged regularly in the alumite layer 54.

The thickness (t) of the alumite layer 54 is adjustable according to the amount of electric charge (=current×time) used for electrolysis. Since the thermal conductivity of the alumite layer 54 is lower than the thermal conductivity of the aluminum base material 52, the aluminum base material 52 is desirably made as thin as possible. The alumite layer 54 has a property of being much harder than the sliding layer 21*c* (see FIG. 3) of the fixing belt 21 that slides on the alumite layer 54.

For example, when compared in terms of Martens hardness, the sliding layer 21*c* of the fixing belt 21 has a value in a range of from 100 ($N/mm^2$) to 300 ($N/mm^2$); whereas the alumite layer 54 has a value of about 3000 ($N/mm^2$).

Therefore, in the present embodiment, the alumite layer 54 has a thickness (t) smaller than at least the thickness of the sliding layer 21*c* of the fixing belt 21. As described above, the sliding layer 21*c* of the fixing belt 21 has a thickness of about 15 μm so as not to cause coating unevenness. Therefore, in the present embodiment, the alumite layer 54 has a thickness (t) of about 5 μm, which is a size about one third of the thickness of the sliding layer 21*c* of the fixing belt 21. The aforementioned thickness (t) of the alumite layer 54 is an example and is not limited thereto.

A pore diameter (d) of the micropores 54*a* is about 100 Å to 500 Å, though the pore diameter (d) varies depending on the treatment liquid used for the anodizing treatment. The number of the micropores 54*a* is such that the micropores 54*a* occupy from 5% to 40% of the surface area of the heat equalizing member 27. The aforementioned pore diameter (d) and the number of the micropores 54*a* are examples and are not limited thereto.

Next, in an aqueous solution containing molybdenum thioate as a main ingredient, the aluminum base material 52 on which the alumite layer 54 is formed is made to the anode and thus secondarily electrolyzed. Then, as illustrated in FIG. 9, the molybdenum sulfide (i.e., molybdenum disulfide 56) is precipitated and fixed in the plurality of micropores 54*a*. This precipitation starts from a base portion 54*b* of the plurality of micropores 54*a* and proceeds toward an inlet (or an outermost surface layer) of the plurality of micropores 54*a* with the passage of the electrolysis time.

A description is now given of a reason why the molybdenum sulfide (i.e., molybdenum disulfide 56) is precipitated from the base portion 54*b*. The molybdenum thioate in the secondary electrolyte dissociates into thiomolybdate ions. Since the ions are negatively charged, the ions are attracted to the anode and enter the micropores 54*a* by electrophoresis or diffusion. Since the size of the ions is much smaller than the size of the micropores 54*a*, the ions reach the depth of the micropores 54*a*. Thus, the molybdenum sulfide (i.e., molybdenum disulfide 56) is precipitated from the base portion 54*b* of the plurality of micropores 54*a*.

When the molybdenum sulfide (i.e., molybdenum disulfide 56) precipitated as described above is heat-treated after the secondary electrolysis, crystals having a graphite structure are formed. As a consequence, as illustrated in FIG. 10, the plurality of micropores 54*a* in the alumite layer 54 is filled with the molybdenum disulfide 56 from the base portion 54*b* to the outermost surface layer of the plurality of micropores 54*a*.

As described above, the heat equalizing member 27 of the present embodiment includes the alumite layer 54 on the surface facing the inner circumferential surface of the fixing belt 21. The plurality of micropores 54*a* in the alumite layer 54 is filled with the molybdenum disulfide 56 from the base portion 54*b* to the outermost surface layer of the plurality of micropores 54*a*. Since the alumite layer 54 is formed by altering the aluminum base material 52, foreign matter is not mixed in during the formation of the alumite layer 54. In addition, a minute convex shape due to coating unevenness does not occur. Accordingly, the inner surface of the fixing belt 21 is immune to local wear.

Further, the molybdenum disulfide 56 fills an entire area in a depth direction of the alumite layer 54. Therefore, even if the alumite layer 54 is worn, the heat equalizing member 27 provides the fixing belt 21 with good slidability unchanged from the initial stage, as long as the alumite layer 54 is present.

Furthermore, according to the present embodiment, the heat equalizing member 27 attains a reduced surface roughness of the surface facing the inner circumferential surface of the fixing belt 21. This is because the surface roughness for holding grease is not particularly needed. With such a reduced surface roughness, the heat equalizing member 27 prevents damage to the inner circumferential surface of the fixing belt 21 when the fixing belt 21 slides over the belt sliding-contact face 27*a*, thus attaining a further advantage. Note that, in the present embodiment, an arithmetic mean roughness (Ra) of the alumite layer 54 is about 0.2 μm to 0.3 μm.

(Variations)

In the embodiment described above, molybdenum disulfide is used as a solid lubricant. However, the solid lubricant is not limited to the molybdenum disulfide. Alternatively, the plurality of micropores 54*a* in the alumite layer 54 may be impregnated and filled with PTFE or fluorine grease.

The thickness (t) of the alumite layer 54 is preferably made as small as possible. From the viewpoint of rigidity, the hardness (e.g., Martens hardness) of the alumite layer 54 is preferably greater than the hardness of the sliding layer 21*c* of the fixing belt 21. In particular, the alumite layer 54 is preferably harder than the sliding layer 21*c* of the fixing belt 21 about three times, and more preferably, in a range of from about 5 times to about 10 times.

Subsequently, a description is given of the heat equalizing performance of a heat equalizing member of the present embodiment.

Figure 11B:
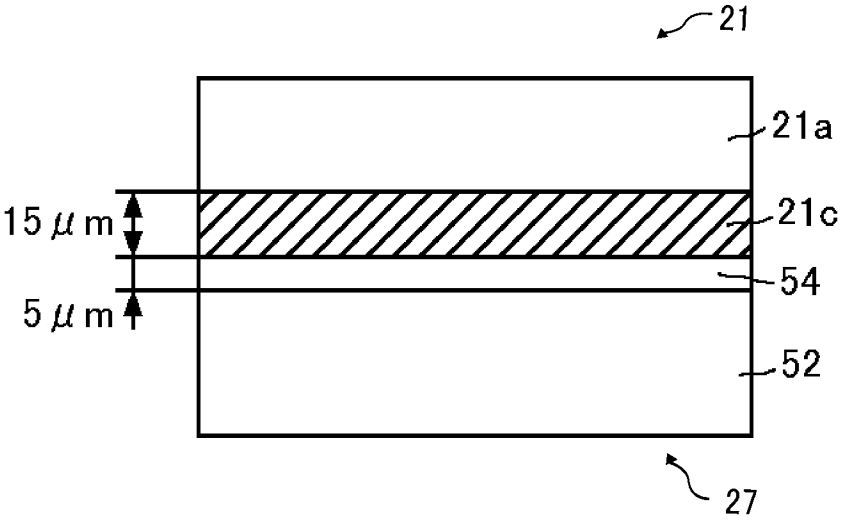
FIG. 11B is a cross-sectional view of a heat equalizing member and a fixing belt, according to an embodiment of the present disclosure.
Figure 11A:
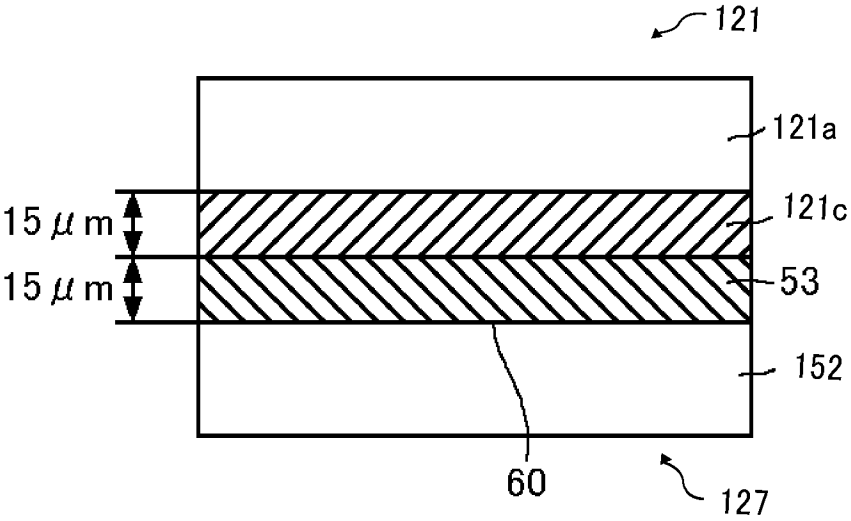

Each of FIG. 11A and FIG. 11B is a cross-sectional view of a heat equalizing member and a fixing belt. Specifically, FIG. 11A illustrates, as a comparative configuration, a configuration of a heat equalizing member 127 and the fixing belt 121. FIG. 11B illustrates a configuration of the heat equalizing member 27 and the fixing belt 21, according to the present embodiment.

Table 1 presents a comparison of a comparative configuration and a configuration of the present embodiment of the fixing belt and the heat equalizing member.

TABLE 1

| | comparative configuration | | | configuration of present embodiment | | |
|---|---|---|---|---|---|---|
| | base (base material) | sliding layer | thickness of sliding layer | base (base material) | sliding layer | thickness of sliding layer |
| fixing belt | e.g., nickel | resin-based material | about 15 μm | e.g., nickel | resin-based material | about 15 μm |
| heat equalizing member | aluminum | resin-based material | about 15 μm | aluminum | alumite | about 5 μm |

As illustrated in FIG. 11A, in the comparative configuration, sliding layers 121*c* and 53 are interposed between an aluminum base material 152 of the heat equalizing member 127 and a base 121*a* of the fixing belt 121 to prevent mutual wear. The sliding layer 53 is a typical resin-based coating material such as polyimide resin or fluororesin. An interface 60 is interposed between the aluminum base material 152 of the heat equalizing member 127 and the sliding layer 53. The total thickness of the sliding layers 121*c* and 53 is about 30 μm.

Note that the thickness of each of the sliding layers 121*c* and 53 is 15 μm for coating without causing coating unevenness, as described above.

By contrast, as illustrated in FIG. 11B, in the configuration of the present embodiment, the sliding layer 21*c* and the alumite layer 54 are interposed between the aluminum base material 52 of the heat equalizing member 27 and the base 21*a* of the fixing belt 21. However, no interface is interposed between the aluminum base material 52 and the alumite layer 54 of the heat equalizing member 27. The total thickness of the sliding layer 21*c* and the alumite layer 54 is about 20 μm.

Since the distance between the aluminum base material 52 of the heat equalizing member 27 and the base 21*a* of the fixing belt 21 is smaller than the distance between the aluminum base material 152 of the heat equalizing member 127 and the base 121*a* of the fixing belt 121, the heat equalizing member 27 of the present embodiment enhances the thermal conductivity. In addition, since no clear interface is interposed between the alumite layer 54 and the aluminum base material 52, the heat equalizing member 27 of the present embodiment is advantageous for heat conduction. Accordingly, the heat equalizing member 27 of the present embodiment enhances the heat equalizing property as compared to a comparative heat equalizing member.

With the configuration described above, a fixing device performs a reliable fixing operation over time. An image forming apparatus including the fixing device is providable as a product that prevents an increase in the fixing unit torque for a long period of time.

Some of the embodiments of the present disclosure have been described in detail. The embodiments have been described as examples and can be implemented with various modifications within the scope of the present invention. For example, in an embodiment described above, the nip forming member 24 and the heat equalizing member 27 are separate members. Alternatively, the heat equalizing member may be provided with a role (or function) as a nip forming member to be an integrated member.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

This patent application is based on and claims priority to Japanese Patent Application No. 2019-227137, filed on Dec. 17, 2019, in the Japan Patent Office, the entire disclosure of which is hereby incorporated by reference herein.

REFERENCE SIGNS LIST

1 image forming apparatus
2 bottle receptacle
2C, 2K, 2M, 2Y toner bottles
3 transfer device
4C, 4K, 4M, 4Y image forming units
5 photoconductor
6 charging device
7 developing device
8 cleaning device
9 exposure device
10 input tray
11 sheet feeding roller
12 registration roller pair
13 sheet ejection roller pair
14 output tray
20 fixing device
21 fixing belt
21*a* base
21*b* release layer
21*c* sliding layer
21*d* elastic layer
22 pressure roller
23A, 23B heaters
24 nip forming member
25 stay member
25*a* arm
27 heat equalizing member
27*a* belt sliding-contact face
28A, 28B reflecting members

29 temperature sensor
30 intermediate transfer belt
31 primary transfer roller
32 secondary transfer backup roller
33 cleaning backup roller
34 tension roller
35 belt cleaning device
36 secondary transfer roller
40 separating member
45 flange
46 receiving portion
47 flange portion
48 slit
52 aluminum base material
53 sliding layer
54 alumite layer
54*a* micropores
54*b* base portion
56 molybdenum disulfide
60 interface
N fixing nip
P sheet

The invention claimed is:

1. A fixing device comprising:
a rotatable and endless fixing belt;
a heat source to heat the fixing belt;
a pressure member disposed outside the fixing belt to face the fixing belt;
an elongated structure disposed inside the fixing belt to form a nip between the fixing belt and the pressure member; and
a heat equalizer to cover a face of the elongated structure, the face facing the fixing belt, and transfer heat in an axial direction of the fixing belt,
the fixing belt including at least: a tubular base made of metal; and a sliding layer including heat resistant resin on an inner circumferential surface of the base,
the heat equalizer being made of aluminum or an aluminum alloy,
the heat equalizer including an alumite layer on a surface facing an inner circumferential surface of the fixing belt,
a plurality of micropores in the alumite layer being filled with a solid lubricant having a coefficient of friction lower than a coefficient of friction of the alumite layer,
the alumite layer having a thickness smaller than a thickness of the sliding layer of the fixing belt,
the plurality of micropores include therein the solid lubricant at a base portion of the plurality of micropores and extends towards an inlet of the micropores, and
the solid lubricant in the plurality of micropores has a structure of crystals including a graphite structure.

2. The fixing device according to claim 1, wherein the solid lubricant is molybdenum disulfide.

3. The fixing device according to claim 1, wherein the solid lubricant is polvtetrafluoroethylene (PTFE) or fluorine grease.

4. The fixing device according to claim 1, wherein the alumite layer has a thickness smaller than 10 rim.

5. An image forming apparatus comprising the fixing device according to claim 1.

6. The fixing device according to claim 1, wherein:
the solid lubricant extends to an outermost surface of the heat equalizer.

7. The fixing device according to claim 1, wherein:
an arithmetic mean roughness of the alumite layer 54 is about 0.2 μm to 0.3 μm.

8. The fixing device according to claim 7, wherein:
the alumite layer is at least five to ten times harder than the sliding layer of the fixing belt.

9. The fixing device according to claim 8, wherein:
a number of the micropores is such that the micropores occupy from 5% to 40% of a surface area of the heat equalizer.

10. The fixing device according to claim 1, wherein:
the alumite layer is at least three times harder than the sliding layer of the fixing belt.

11. The fixing device according to claim 1, wherein:
a pore diameter of the micropores is 100 A to 500 A.

12. The fixing device according to claim 1, wherein:
a number of the micropores is such that the micropores occupy from 5% to 40% of a surface area of the heat equalizer.

* * * * *